US005404610A

United States Patent [19]

Coyer, Sr. et al.

[11] Patent Number: 5,404,610

[45] Date of Patent: Apr. 11, 1995

[54] PORTABLE DUAL SIZE GOLF CLUB CLEANER

[76] Inventors: Donald F. Coyer, Sr.; Catherine G. Coyer, both of 8951 Bonita Beach Rd., Ste. 525-267, Bonita Springs, Fla. 33923

[21] Appl. No.: 243,938

[22] Filed: May 17, 1994

[51] Int. Cl.[6] ..... A63B 57/00; A46B 11/00

[52] U.S. Cl. ..... 15/104.92; 15/160

[58] Field of Search ..... 15/21.2, 104.92, 160, 15/21.1, 88.1

[56] References Cited

U.S. PATENT DOCUMENTS

| | | | |
|---|---|---|---|
| 267,751 | 1/1883 | Dobyns | D32/1 |
| 308,766 | 6/1890 | Van Rensburg | D4/119 |
| 2,617,132 | 11/1952 | Goller | 15/21.2 |
| 2,744,276 | 5/1956 | Chambless | 15/104.92 |
| 3,304,659 | 2/1967 | Eichhorn | 15/21.2 |
| 3,748,676 | 7/1973 | Warren et al. | 15/21.2 |
| 4,380,839 | 4/1983 | Caradonna | 15/104.92 |
| 4,734,952 | 4/1988 | Parchment et al. | 15/104.92 |
| 4,821,358 | 4/1989 | Wyckoff et al. | 15/104.92 |
| 4,965,906 | 10/1990 | Mauro | 15/104.92 |
| 5,155,883 | 10/1992 | Legault | 15/21.2 |

*Primary Examiner*—Edward L. Roberts, Jr.

*Attorney, Agent, or Firm*—Rhodes & Ascolillo; Henry S. Miller, David L. Baker

[57] ABSTRACT

A portable golf club cleaning device including a plastic pail containing a cleaning fluid and a cover for the pail having a large and a small opening. Brushes attached to the cover extend into the fluid and surround each opening so that a golf club placed into the hole will be scrubbed by the brushes and washed by the fluid. The brushes are limited in deflection due to insertion of the club between the brushes, by strapping opposite facing pairs of brushes together near the end away from the mounting. The container has a handle for lifting and carrying.

11 Claims, 2 Drawing Sheets

10
12
14
16
18
19
20
21
22
24
25
26
28
30
31
32
33
34
35
36
37
3
4

PORTABLE DUAL SIZE GOLF CLUB CLEANER

BACKGROUND OF THE INVENTION

1. Field of the invention

The invention relates generally to a device for cleaning golf clubs and more specifically to a device that is portable and provides for cleaning means for cleaning large and small clubs separately.

2. Description of the prior art

Every sport has its fine points which can help or hinder the player depending on how well he knows and uses them to his advantage. One of the fine points in the game of golf is that the ball will travel farther when hit with a club having clean grooves, all other things of course being equal. The golf club tends to pick up dirt, mud, and grass simply by virtue of its use in hitting a ball on the ground. It is desirable then, for golf courses to have stationed about the course, sites where players can clean their clubs as they play their round.

Stations for cleaning clubs and balls have been in use for some time but all have a common short coming in that they all attempt to use one arrangement to clean both large and small golf clubs. With the existing club cleaning devices it is, as a practical matter, impossible to clean large clubs such as the wooden clubs. The apertures are simply not designed to handle these clubs and they are usually only cleaned when the player returns to the club house or when he returns home.

The prior art shows examples of golf club and ball washing devices, none of which will allow the cleaning of both large and small clubs in the apparatus. For example, U.S. Pat. No. 4,734,952 issued Apr. 5, 1988 to Parchment, et al. shows a container for mounting on the rear of a golf cart containing brushes and a flap to prevent the fluid from spilling. FIG. 5 of the patent shows a typical small club being cleaned. In this view it would be impossible for the device to entertain a larger club. U.S. Pat. No. 4,821,358 issued Apr. 18, 1989 to Wyckoff, et al. shows a pair of opposed brushes in a container of washing fluid and a cover that will not allow the larger club to pass through, also the brushes, in such close proximity would not accept the larger club. U.S. Pat. No. 5,155,883 issued Oct. 20, 1992 to Legault shows a box of fluid with a pair of hand driven cylindrically shaped brushes that will clean all size clubs but in a manner far different then that of the device claimed herein. Design patents U.S. Pat. Des. No. 267,751 issued Jan. 25,1983 to Dobyns and U.S. Pat. Des. No. 308,766 issued Jun. 26, 1990 to Van Rensburg show golf club cleaners which fail to anticipate the device disclosed herein.

SUMMARY OF THE INVENTION

The invention provides a simple and inexpensive means for cleaning golf clubs of all sizes and shapes that is portable and easily serviced. Accordingly these are among the objects of the invention.

Utilizing a plastic container with a wire bail handle the club cleaner may be transported to areas around the golf course where cleaning stations, temporary for weekend or tournament crowds or semi-permanent for the season, may be set up. The cover of the container is made to have a secure snap tight fit and will not disengage from the container accidently. Attached to the inside surface of the cover, when the container is closed, are a number of brushes having wooden or plastic backs. The brushes are of sufficient length that when mounted by their longitudinal axis they will extend into the cleaning fluid in the plastic container. The cover contains two openings, one rectangular in shape and the second circular in shape. The openings are restricted in part by the brushes whose bristles face each other and actually engage and scrub the golf club. The circular opening is designed to accommodate larger clubs, hence the opening is larger and the brushes more widely spaced then the rectangular opening where the ends of the bristles in some instances actually touch. Near the end of each brush, opposite from the attached end, are flexible plastic members that connect opposite pairs of brushes together and inhibit separation when the golf club is inserted for cleaning.

The cleaning fluid, which may be simply soap and water, is easily changed by merely removing the cover and dumping the water. The brushes are attached to the cover by any suitable fastener means such as a threaded screw. Because of the brushes in proximity to the openings the cleaning fluid tends not to spill in the event of accidental vibration or bumping of the container. A ridge around the circumference of the container controls the normal drippage off the golf club and this fluid drains back into the container.

It is therefore an object of the invention to provide a new and improved dual size golf club cleaner.

It is another object of the invention to provide a new and improved golf club cleaner that will clean clubs of all sizes.

It is a further object of the invention to provide a new and improved golf club cleaner that is low in cost.

It is still another object of the invention to provide a new and improved golf club cleaner that is of durable and reliable construction.

It still a further object of the invention to provide a new and improved golf club cleaner that may be easily and efficiently manufactured and marketed.

These and other advantages, features and objects of the invention will become more apparent from the following description taken in connection with the illustrative embodiment in the accompanying drawings.

DESCRIPTION OF THE DRAWINGS

FIG. I is a perspective view of the invention illustrating golf clubs over the appropriate openings in the cover.

DESCRIPTION OF THE PREFERRED EMBODIMENT

Figures 1, 2:
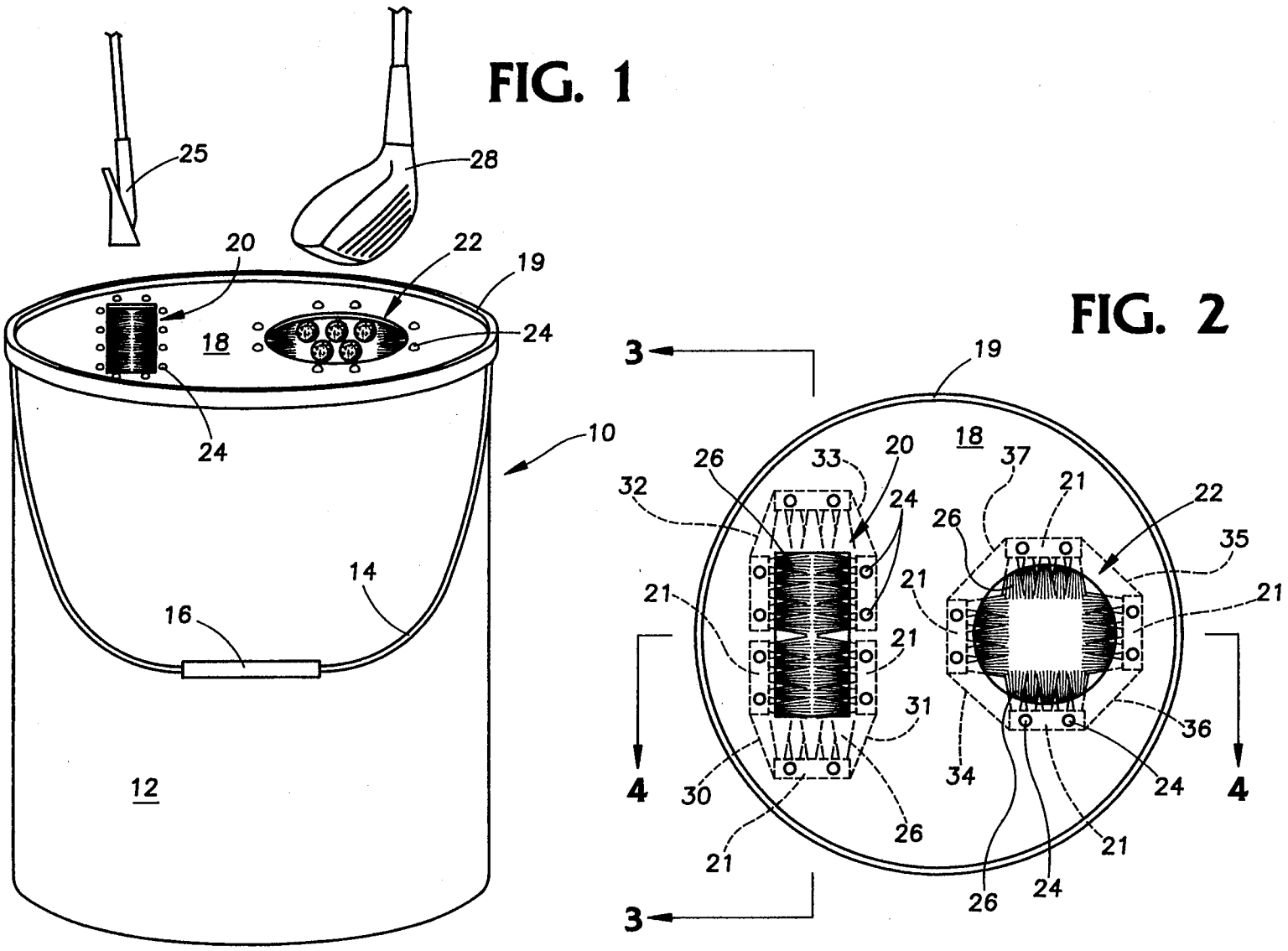
FIG. 2 is a plan view of the cover of the invention showing the brush alignment.

Referring now to FIG. 1 the golf club cleaner apparatus is shown generally at 10. The apparatus consists of a container 12 which is preferably plastic or other material that resists corrosion. A bail 14 with hand grip 16 allows the container to be conveniently lifted and carried with or without cleaning fluid. Cover 18 is shown with ridge 20 which forms part of the cover securing system which is not part of this invention. Rectangular aperture 20 and circular aperture 22 are shown in the cover. Proximate to the edge of each aperture are a plurality of screw heads 24 which engage the cleaning brushes as will be explained hereinafter. Small club 26 is shown poised over the opening 20 while large club 28 is poised over opening 22.

In FIG. 2 there is seen cover 18 and ridge 20 with rectangular aperture 20 and circular aperture 22. Brush blocks 21 are suspended from the cover and held in place by threaded screws 24. Bristles 26 extend from the brush block and end in a juxtaposition with the bristles from the facing brush on the rectangular opening 20 and only slightly spaced in the circular opening 22.

Figure 4:
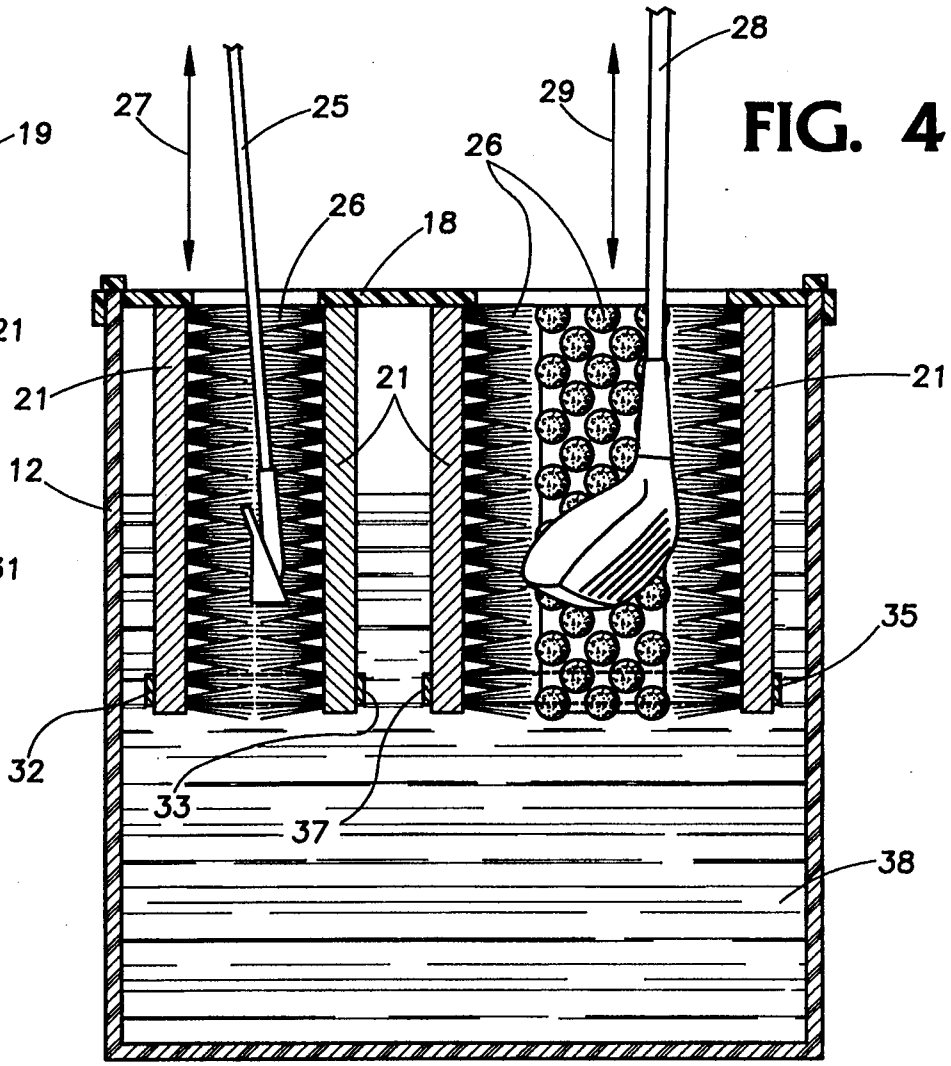
FIG. 4 is a cross sectional view of the invention taken along line 4—4 as shown in FIG. 2.
Figure 3:
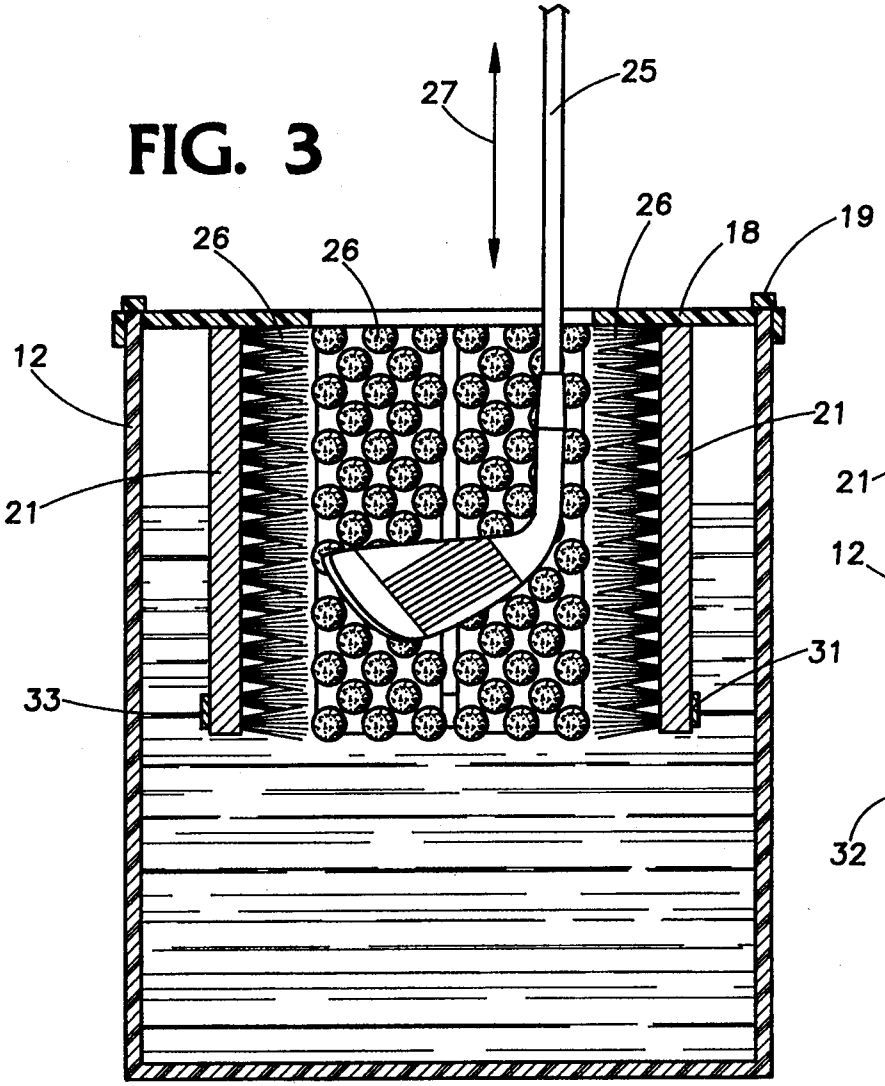
FIG. 3 is a cross sectional view of the invention taken along line 3–3 as shown in FIG. 2.

Concerning FIGS. 3 and 4, container 12 with cover 18 is shown with cleaning fluid 28 and brush blocks 21 suspended from the cover into the fluid. Club 25 is shown engaged by the bristles 26 and is scrubbed as it is moved in the direction indicated by arrow 27. Similarly club 28 is scrubbed when moved in the direction indicated by arrow 29. It is important that the brushes keep as near uniform pressure on the clubs as possible and to that end, flexible straps connect opposite brushes as shown in FIG. 2 at 30, 32 and 34, 36. The straps are connected as representatively shown at 31, 33 and 35,37, also in FIG. 2.

The invention as shown is particularly strong, light weight and efficient in cleaning mud, dirt and grass stains from golf clubs.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A portable cleaning device for golf clubs comprising: a cylindrically shaped container having a bottom and a removable cover, capable of holding a quantity of liquid; a first aperture in said cover; a second aperture in said cover; a plurality of facing pairs of cleaning members attached to the cover proximate the first aperture; a plurality of facing pairs of cleaning members attached to the cover proximate the second aperture; each plurality of facing pairs of cleaning members including at least one pair facing at substantially right angles to the remaining pairs of cleaning members; means connected between facing pairs of cleaning members to limit the separation thereof and means attached to the container for lifting and carrying said container.

2. A portable cleaning device for golf clubs according to claim 1 wherein:

the first aperture is rectangular in shape.

3. A portable cleaning device for golf clubs according to claim 2 wherein:

the second aperture is circular in shape.

4. A portable cleaning device for golf clubs according to claim 3 wherein:

the cleaning members are bristles mounted in blocks.

5. A portable cleaning device for golf clubs according to claim 4 wherein:

the cleaning members are wooden brush blocks.

6. A portable cleaning device for golf clubs according to claim 4 wherein:

the cleaning members are plastic brush blocks.

7. A portable leaning device for golf clubs according to claim 4 wherein:

the brush blocks are attached to the cover by threaded screws.

8. A portable cleaning device for golf clubs according to claim 1 wherein:

the brushes extend from the cover into the container.

9. A portable cleaning device for golf clubs according to claim 8 wherein:

the brushes proximate each aperture are in a parallel faced relation.

10. A portable cleaning device for golf clubs according to claim 9 wherein:

the brushes proximate the first aperture are in a closer spaced relation then the brushes proximate the second aperture.

11. A portable cleaning device for golf clubs according to claim 10 wherein:

the brushes are adapted to extend into fluid in the container.

* * * * *